US010539910B2

(12) United States Patent
Takase

(10) Patent No.: US 10,539,910 B2
(45) Date of Patent: Jan. 21, 2020

(54) IMAGE FORMING APPARATUS HAVING GROUNDING OF TRANSFER MATERIAL GUIDE MEMBER

(71) Applicant: CANON KABUSHIKI KAISHA, Tokyo (JP)

(72) Inventor: Kazuki Takase, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/014,613

(22) Filed: Jun. 21, 2018

(65) Prior Publication Data

US 2019/0004455 A1 Jan. 3, 2019

(30) Foreign Application Priority Data

Jul. 3, 2017 (JP) ..... 2017-130433

(51) Int. Cl.

| | |
|---|---|
| ***G03G 15/16*** | (2006.01) |
| ***G03G 21/18*** | (2006.01) |
| ***G03G 21/16*** | (2006.01) |
| *G03G 15/01* | (2006.01) |

(52) U.S. Cl.

CPC ..... *G03G 15/165* (2013.01); *G03G 21/1638* (2013.01); *G03G 21/1807* (2013.01); *G03G 15/0121* (2013.01); *G03G 15/0131* (2013.01); *G03G 15/1615* (2013.01); *G03G 21/1609* (2013.01); *G03G 21/1633* (2013.01); *G03G 2215/00616* (2013.01)

(58) Field of Classification Search

USPC ..... 399/107, 110, 121, 167, 297, 302, 308, 399/310, 316, 388

See application file for complete search history.

(56) References Cited

U.S. PATENT DOCUMENTS

| | | | | |
|---|---|---|---|---|
| 6,911,993 | B2 * | 6/2005 | Nishikawa | B41J 29/393 347/116 |
| 8,005,412 | B2 | 8/2011 | Sakashita et al. | |
| 8,688,006 | B2 * | 4/2014 | Kobayashi | G03G 15/0189 399/167 |
| 8,913,932 | B2 * | 12/2014 | Akamatsu | G03G 15/5058 399/301 |
| 9,389,561 | B2 * | 7/2016 | Kobayashi | G03G 15/0131 |
| 9,996,029 | B2 | 6/2018 | Matsumoto et al. | |

FOREIGN PATENT DOCUMENTS

| | | |
|---|---|---|
| JP | 2002-196594 A | 7/2002 |
| JP | 2004-258200 A | 9/2004 |
| JP | 2009-128481 A | 6/2009 |
| JP | 2015-082065 A | 4/2015 |

* cited by examiner

*Primary Examiner* — Hoan H Tran
(74) *Attorney, Agent, or Firm* — Venable LLP

(57) ABSTRACT

In an image forming apparatus, a transfer material transport guide is disposed in an optical sensor unit to support a color deviation sensor, which is disposed near an intermediate transfer belt. By changing the position of the optical sensor unit, the grounding path of the transfer material transport guide can be changed, and both transfer bias leak prevention for the transfer material transport guide and electrostatic breakdown prevention for the color deviation sensor can be implemented. As a result, the apparatus can be downsized, and when the intermediate transfer belt is replaced, the optical sensor unit can be moved to create a space necessary for the replacement.

16 Claims, 5 Drawing Sheets

IMAGE FORMING APPARATUS HAVING GROUNDING OF TRANSFER MATERIAL GUIDE MEMBER

BACKGROUND OF THE INVENTION

Field of the Invention

The present invention relates to an image forming apparatus using an electrophotographic system or an electrostatic recording system, and more particularly to an image forming apparatus which includes an optical detection portion.

Description of the Related Art

Downsizing of the entire image forming apparatus has been a critical issue, and a known downsizing technique for a color image forming apparatus is that toner images of respective colors on an image bearing member are once transferred onto an intermediate transfer belt, and the toner images of a plurality of colors on the intermediate transfer belt are collectively transferred to a recording material.

Generally speaking, a toner image is transferred from the intermediate transfer belt to a transfer material by a transfer portion using an electrostatic transfer process, in which transfer bias (transfer voltage) is applied, and electrostatic attraction is generated so as to form an electric field having the reverse polarity of the charging polarity of the toner image. As a method of preventing transfer failure in such a transfer portion by leakage of the transfer bias, Japanese Laid-open Patent Publication No. 2009-128481 discloses a method of grounding using a static elimination circuit which can switch the resistance value of the transfer material transport guide.

This image forming apparatus also includes a color resist control portion. First a resist mark (toner mark) using the toner of each color is formed on the intermediate transfer belt as a reference image for resist detection, by forming the toner image on the photosensitive drum and transferring the toner image onto the intermediate transfer belt. Then the resist marks are detected by an optical sensor, which is installed on the downstream side of the black image (last color) forming portion of the intermediate transfer belt, and color resist control, such as correcting the image writing start position onto the photosensitive drum, is performed. The optical sensor is disposed to irradiate the light of the optical sensor to a position where the intermediate transfer belt is wound around the rollers, so that the intermediate transfer belt does not deviate in the surface direction causing a change in the distance between the optical sensor and the intermediate transfer belt. In such an optical sensor, Japanese Laid-open Patent Publication No. 2015-82065 discloses a method of disposing a conductive member, to attract the discharged current, near the optical sensor for grounding, to prevent an electrostatic breakdown caused by user access when the intermediate transfer belt is replaced or the transfer material is jammed.

SUMMARY OF THE INVENTION

The method of disposing the static elimination circuit in the grounding path of the transfer material transport guide, however, requires a connection with the control portion and a dedicated static elimination circuit, which increases the size of the apparatus main body, and increases cost.

Further, the method of disposing a conductive member near the optical sensor for grounding requires a dedicated conductive member and a grounding path, which also increases the size of the apparatus main body, and increases cost.

The transfer material transport guide requires the static elimination circuit, and the optical sensor must be grounded by the conductive member disposed near the optical sensor, and the demanded resistance values of the transfer material transport guide and the optical sensor are different from each other. Therefore separate grounding paths are required so that electricity does not leak from the transfer material transport guide to the conductive member near the optical sensor. In this way, the transfer material transport guide and the optical sensor cannot be disposed in close proximity, which makes downsizing of the product difficult.

Furthermore, as the position of the optical sensor is closer to the intermediate transfer belt, the optical sensor can receive stronger reflected light, and the resolution of the optical sensor can be increased by condensing the light of the spectroscopic sensor, which can receive large light quantities. However, as the optical sensor is closer to the intermediate transfer belt, there is higher possibility that the optical sensor may be contacted to the intermediate transfer belt and be scratched when the intermediate transfer belt is replaced.

With the foregoing in view, it is an aspect of the present invention to implement the static elimination of the transfer transport guide, the prevention of the electrostatic breakdown of the optical sensor, and the improvement of the resolution of the optical sensor, while enabling the downsizing of the apparatus. It is another aspect of the present invention to provide an image forming apparatus which allows acquiring high quality color images by performing high precision color resist control.

With a view to achieving one aspect as described above, an image forming apparatus, includes:

- an image bearing member configured to bear a toner image;
- a guide member configured to guide a transfer material to a transfer portion for transferring the toner image from the image bearing member to the transfer material; and
- an electric unit that includes a device configured to be activated by electric power supply, wherein
- the electric unit is configured to move to a first position and to a second position that is more retracted from the image bearing member than the first position,
- the guide member is grounded via a resistance member when the electric unit is positioned at the first position, and
- the guide member is grounded without the resistance member when the electric unit is positioned at the second position.

Therefore the present invention can implement the static elimination of the transfer transport guide, the prevention of the electrostatic breakdown of the optical sensor, and the improvement of the resolution of the optical sensor, while enabling the downsizing of the apparatus. Further, the present invention can provide an image forming apparatus which allows acquiring high quality color images by performing high precision color resist control.

Further features of the prevent invention will become apparent from the following description of exemplary embodiments with reference to the attached drawings.

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

EXAMPLE 1

Figure 1:
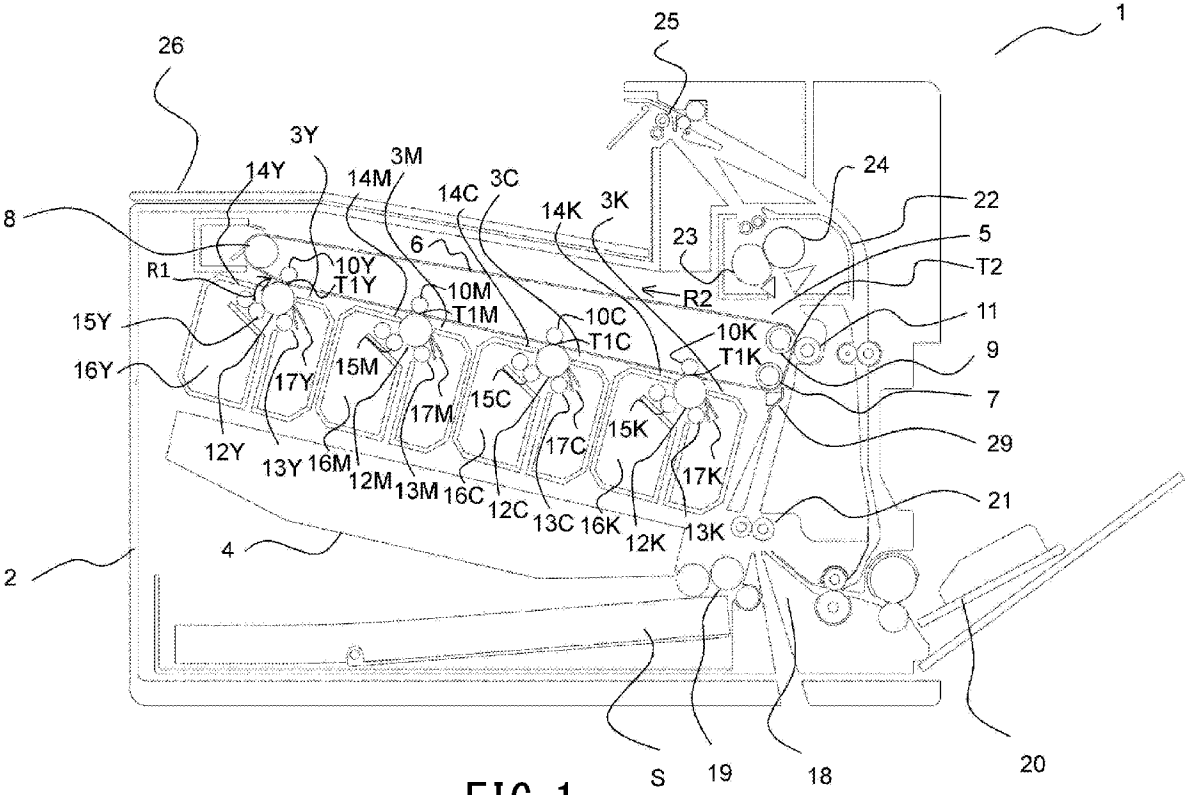
FIG. 1 is a schematic cross-sectional view illustrating an image forming apparatus 1 according to Example 1 of the present invention.

FIG. 1 is a schematic cross-sectional view of an image forming apparatus 1 according to an embodiment of the present invention. The image forming apparatus 1 of Example 1 can form a full color image using an electrophotographic system. This apparatus is a tandem type (four-connected drum type) color laser beam printer using the intermediate transfer system.

The image forming apparatus 1 includes first, second, third and fourth process cartridges 3Y, 3M, 3C and 3K, which are disposed in a row as a plurality of image forming portions. These process cartridges, 3Y, 3M, 3C and 3K, form yellow (Y), magenta (M), cyan (C), and black (K) toner images, respectively. Below the process cartridges 3Y, 3M, 3C and 3K, a laser scanner 4 serving as an exposing portion is disposed. Above these process cartridges 3Y, 3M, 3C and 3K, an intermediate transfer unit 5 is disposed for transferring the toner images, formed by the process cartridges 3Y, 3M, 3C and 3K, onto a transfer material S.

A composing element of each process cartridge having substantially the same configuration and the function to form each color image is described in general, omitting Y, M, C or K attached to each reference sign to indicate the color of the composing element, unless necessary.

The process cartridge 3 includes a photosensitive drum 12, which is a rotatable drum type (cylindrical) electrophotographic photosensitive member serving as a primary image bearing member. The process cartridge 3 also includes, as a processing portion to operate a photosensitive drum 12: a charging roller 13 which is a roller type charging member serving as a charging portion; a developing apparatus 14 serving as a developing portion; and a drum cleaning apparatus 17 serving as a photosensitive member cleaning portion. The photosensitive drum 12, the charging roller 13, the developing apparatus 14 and the drum cleaning apparatus 17 are integrated, and can be detachably attached to the image forming apparatus 1.

The photosensitive drum 12 is rotatably driven in an arrow R1 direction indicated in FIG. 1 by a drive source and drive train (not illustrated) at a predetermined velocity (peripheral velocity). The surface of the rotating photosensitive drum 12 is uniformly charged at a predetermined potential having a predetermined polarity (negative polarity in Example 1) by the charging roller 13. At this time, a predetermined charging voltage (charging bias) is applied to the charging roller 13. The charged surface of the photosensitive drum 12 is scanned and exposed by the laser beam irradiated from the laser scanner 4 according to the image information of each color component. Thereby an electrostatic image (electrostatic latent image), in accordance with the image information of each color component, is formed on the photosensitive drum 12. The electrostatic image formed on the photosensitive drum 12 is developed (visualized) as a toner image using toner, which is a developer, by the developing apparatus 14. The toner is stored in a developer container 16 of the developing apparatus 14. At this time, a predetermined developing voltage (developing bias) is applied to the developing roller 15 of the developing apparatus 14. In Example 1, the toner image is formed by exposure of the image portion and reversal development. In other words, the developing apparatus 14 allows toner, charged at the same polarity as the charging polarity of the photosensitive drum 12 (negative polarity in Example 1), to adhere to the exposed portion of the photosensitive drum 12 where the absolute value of the potential was decreased by being exposed after uniform charging.

The intermediate transfer unit 5 includes an intermediate transfer belt 6 constituted by an endless belt, which functions as a secondary image bearing member and an intermediate transfer member, and is disposed to face the four photosensitive drums 12Y, 12M, 12C and 12K. Here, as a toner image having at least one color, a four-color toner image is borne on the intermediate transfer belt 6. The intermediate transfer belt 6 is an example of a movable member that is used in the image forming apparatus 1. The intermediate transfer belt 6 is wound around a drive roller 7, a tension roller 8 and a secondary transfer counter roller 9, which serve as a plurality of stretching rollers. The intermediate transfer belt 6 is wound around the plurality of stretching rollers in a state of receiving a predetermined tensile strength by the tension roller 8. The intermediate transfer belt 6 rotates (circulates) at a predetermined velocity (peripheral velocity) in the arrow R2 direction indicated in FIG. 1 by a drive force generated when the drive roller 7 is rotated by a drive source and a drive train (not illustrated). On the rear surface (inner peripheral surface) side of the intermediate transfer belt 6, primary transfer rollers 10Y, 10M, 10C and 10K, which are roller type primary transfer members serving as primary transfer portions, are disposed in positions facing photosensitive drums 12Y, 12M, 12C and 12K, respectively. The primary transfer roller 10 is pressed toward the photosensitive drum 12 via the intermediate transfer belt 6, and forms a primary transfer portion (primary transfer nip) T1 where the intermediate transfer belt 6 and the photosensitive drum 12 are contacted. On the front surface (outer peripheral surface) side of the intermediate transfer belt 6, a secondary transfer roller 11, which is a roller type secondary transfer member serving as a secondary transfer portion, is disposed in a position facing the secondary transfer counter roller 9. The secondary transfer roller 11 is pressed toward the secondary transfer counter roller 9 via the intermediate transfer belt 6, and forms a secondary transfer portion (secondary transfer nip) T2 serving as a transfer portion where the intermediate transfer belt 6 and the secondary transfer roller 11 are contacted.

The toner image formed on the photosensitive drum 12 is transferred onto the intermediate transfer belt 6 at each primary transfer portion T1 because of the function of the primary transfer roller 10 (primary transfer). At this time, a predetermined primary transfer voltage (primary transfer bias), which is a DC voltage having a reversed polarity of the charging polarity of the toner during development (normal charging polarity), is applied to the primary transfer roller 10. For example, when a full color image is formed, a toner image having each color formed on the four photosensitive drums 12Y, 12M, 12C and 12K, respectively, is sequentially transferred onto the intermediate transfer belt 6 so as to be superimposed, whereby multiple toner images for a full color image are formed on the intermediate transfer belt 6.

The toner image formed on the intermediate transfer belt 6 is transferred onto the transfer material S, which is held between the intermediate transfer belt 6 and the secondary transfer roller 11, and is transported in the secondary transfer portion T2, because of the function of the secondary transfer roller 11 (secondary transfer). At this time, a predetermined secondary transfer voltage (secondary transfer bias), which is a DC voltage having a reversed polarity of the normal charging polarity of the toner, is applied to the secondary transfer roller 11.

The transfer material S, such as a recording paper and a plastic sheet, is supplied to the secondary transfer portion T2 by a feeding apparatus 18. The feeding apparatus 18 includes a cassette feeding portion 19, which separates and feeds the stacked and stored transfer material S one by one, a manual feeding portion 20, and a resist roller pair 21 which transports the transfer material S to the secondary transfer portion T2 at a predetermined timing.

The transfer material S, on which the toner image is transferred, is held by a fusing nip, which is constituted by a fusing roller 23 and a pressure roller 24, and is transported in a fusing apparatus 22 serving as a fusing portion, and during this process, heat and pressure are applied to the transfer material S, whereby the toner image is fused (firmly fixed) thereon. Then the transfer material S is transported by a discharge roller pair 25 and the like, and is discharged to a tray 26, which is disposed on the top surface of the image forming apparatus 1.

On the downstream side of the black (last color) image forming portion on the intermediate transfer belt 6, an optical sensor unit 29 is disposed, and detects a resist mark 28 (toner mark) generated by each color toner, which is a reference image for detecting color resist formed on the intermediate transfer belt 6. Then, based on this detection result, a color resist correction, such as correcting the image writing start position onto the photosensitive drum 12, is performed.

Figure 2A:
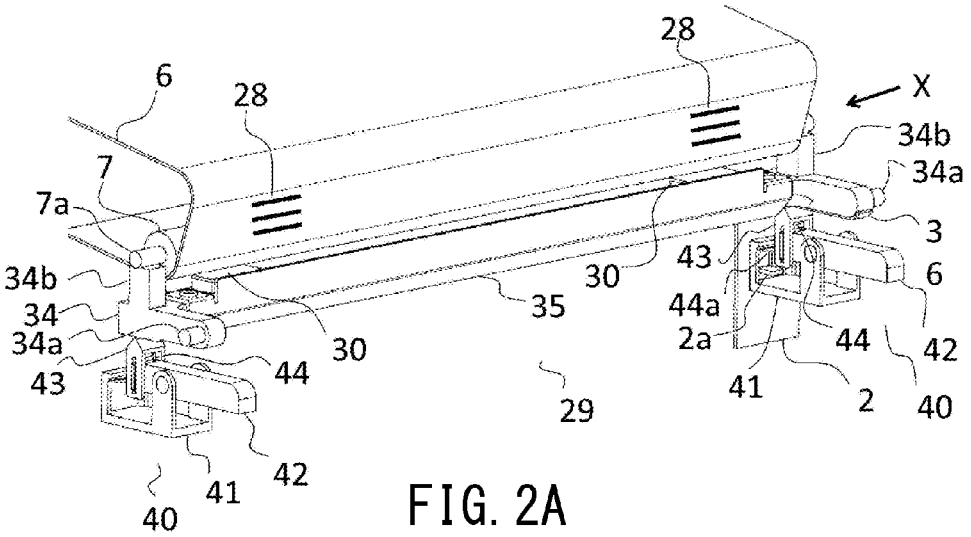
FIGS. 2A and 2B illustrate general views of an optical sensor unit 29 according to Example 1 of the present invention.
Figure 2B:
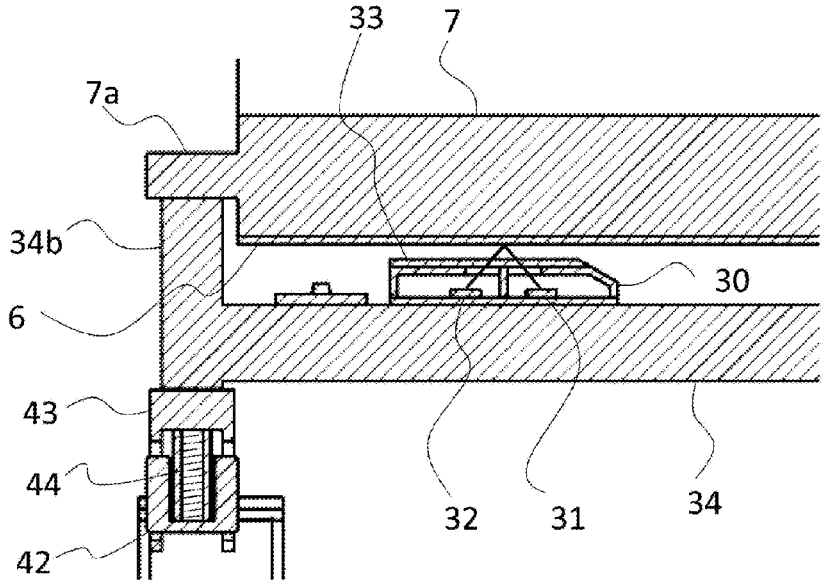

An optical sensor unit 29 serving as an electric unit will be described with reference to FIGS. 2A, 2B, 3A and 3B. FIG. 2A is a general perspective view of the optical sensor unit 29, and FIG. 2B is a cross-sectional view of the sensor device of the optical sensor unit 29. As illustrated in FIG. 2B, an optical sensor 30, which is a sensor device, is constituted by a combination of: an LED 31 which emits light; and a photo transistor 32 which receives the reflected light thereof reflected by the intermediate transfer belt 6. A transparent cover glass 33 is set on the LED 31 and the photo transistor 32, to be protected from the contamination caused by dust in the air and a small amount of toner coming from the toner image on the intermediate transfer belt 6. "Device" here refers to an element or apparatus which is activated by electric power supply, and plays a specific function, and is not limited to the optical sensor. As illustrated in FIG. 2A, the optical sensor 30 is disposed at two locations on both ends of the intermediate transfer belt 6 in the width direction, so as to correspond to the two rows of the resist marks 28 which are formed along the belt moving direction at both ends of the intermediate transfer belt 6 in the width direction, and these optical sensors 30 are held by an optical sensor support member 34. The optical sensor support member 34 is disposed where the intermediate transfer belt 6 is stretched and wound around the drive roller 7, allowing the light of the optical sensor 30 to irradiate this position, while preventing a change in the distance of the optical sensor 30 and the intermediate transfer belt 6, due to a deviation of the belt surface of the intermediate transfer belt 6 in the surface direction. The optical sensor support member 34 is held such that a shaft 34*a* of the optical sensor support member 34 can rotate in a hole portion of the main body frame 2. The optical sensor support member 34 is positioned by a contact portion 34*b* being biased toward a drive roller shaft 7*a* of the drive roller 7 by a biasing unit 40 (described later), and the contact portion 34*b* contacting the drive roller shaft 7*a*. In the optical sensor unit 29, a metal transfer material transport guide 35 serving as a guide member is disposed, so as to guide the transfer material S to the secondary transfer portion T2 illustrated in FIG. 1, and to ensure the rigidity of the optical sensor unit 29. Since the optical sensor unit 29 is positioned with respect to the drive roller 7 of the intermediate transfer unit 5, the transfer material S can be accurately guided to the secondary transfer portion T2. In the optical sensor support member 34, a first earth or ground member (support receiving portion) 36 made of conductive material is also disposed to ground from the transfer material transport guide 35 to the biasing unit 40 (described later).

The biasing unit 40 will be described next. The biasing unit 40 is attached to the main body frame 2. The biasing unit 40 is constituted by: a biasing base 41 which is made of semiconductive material; a biasing link 42 which is rotatably disposed in the biasing base 41; a biasing cap 43 which is made of semiconductive material, and which biases the optical sensor support member 34; and a biasing spring 44 which is a compression spring to apply biasing force. The biasing base 41 made of semiconductive material includes polyethylene terephthalate (PET) as an injection molding material. Here PET has the volume resistance of 10^12 to 4.9×10^14 Ω·cm, for example.

Figure 3A:
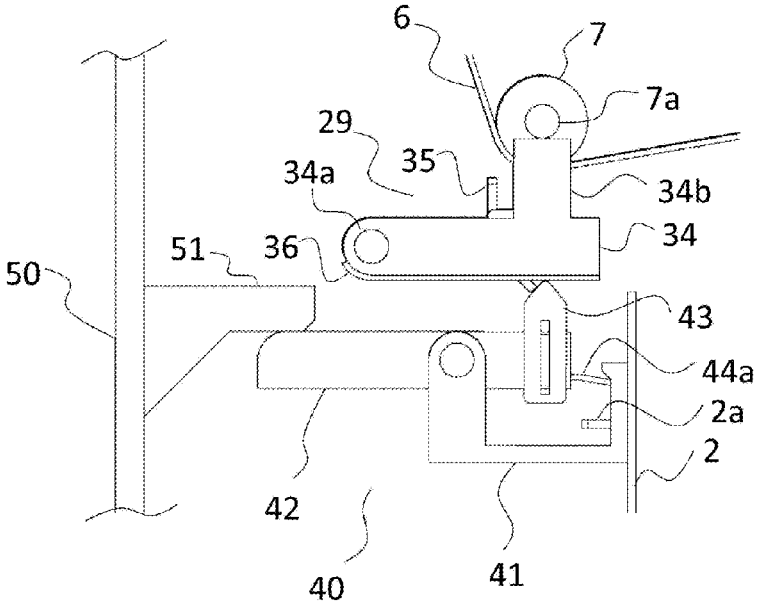
FIGS. 3A and 3B are rear views illustrating the operation of the optical sensor unit 29 according to Example 1 of the present invention.

The operation of the optical sensor unit 29 will be described next, with reference to FIGS. 3A and 3B, which are views in the X direction indicated in FIG. 2A. As illustrated in FIG. 3A, in the biasing unit 40, the biasing link 42 is pressed by a biasing link pressing member 51 when the biasing link pressing member 51 (engaging portion), disposed in an intermediate transfer unit replacement door 50 serving as an opening and closing member, engages with the biasing link 42 (receiving portion). Thereby the biasing force of the biasing spring 44 is transferred to the biasing cap 43, and the optical sensor unit 29 is located at a first position, where the optical sensor unit 29 is biased to the drive roller shaft 7*a*. At this time, the biasing cap 43 (first support portion) contacts the first earth member, whereby the optical sensor unit 29 is supported at the first position via the biasing cap 43. A biasing spring conducting portion (conducting portion) 44*a*, which is at one end of the biasing spring 44, is biased to the biasing base 41. As a result, the transfer material transport guide 35 is electrically connected from the first earth member 36 via the biasing cap 43 and the biasing spring 44 to the biasing base 41, which is made of semiconductive material, is attached to the main body frame 2 and serves as a resistance member, and the transfer material transport guide 35 is therefore grounded through the semiconductive material.

Figure 3B:
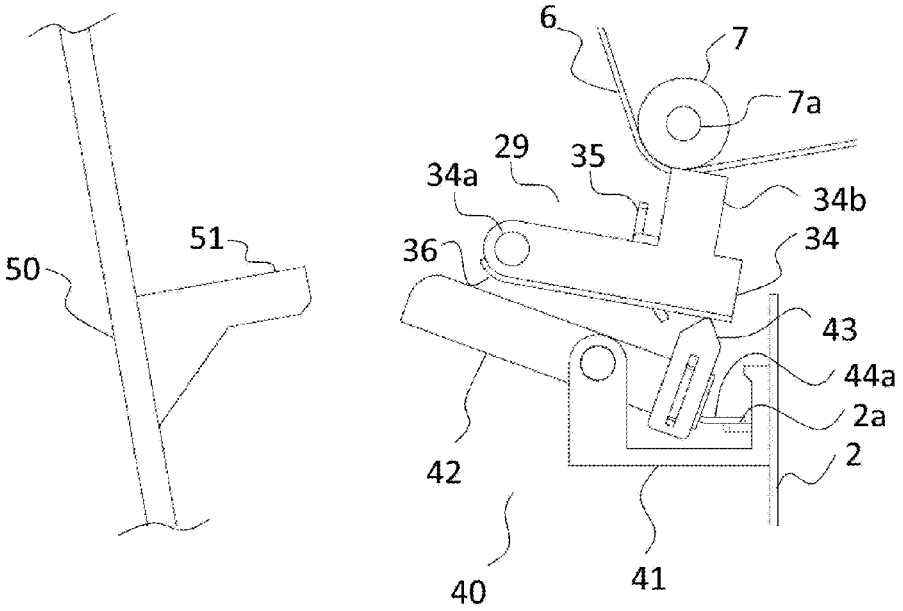

On the other hand, when the intermediate transfer unit replacement door 50 is open, and the inside of the image forming apparatus is exposed by the user access operation to replace the intermediate transfer unit 5 or to remove jammed transfer material, as illustrated in FIG. 3B, the biasing link pressing member 51 and the biasing link 42 are disengaged from each other. This means that the biasing link 42 cannot be pressed by the biasing link pressing member 51 in this state. Therefore the optical sensor unit 29 is located at the second position where the optical sensor unit 29 is not biased to the drive roller 7. At this time, the optical sensor unit 29 is supported at the second position by the biasing cap 43. The second position is the position more retracted from the intermediate transfer belt 6 than the first position. The second position is also a position where a space is provided, so that the intermediate transfer belt 6 or the intermediate transfer unit 5, which includes the intermediate transfer belt 6, can be attached or detached, or jammed transfer material can be removed. The biasing link 42 rotates in a direction departing from the drive roller 7, because of the weight of the optical sensor unit 29. The biasing spring conducting portion 44*a*, which is one end of the biasing spring 44, is biased to the conducting portion (first conductive member) 2*a* of the main body frame 2 constituted by a metal plate or the like made of semiconductive material. Thereby the transfer material transport guide 35 is electrically connected from the first earth member 36 to the main body frame 2 via the biasing cap 43 and the biasing spring, and is therefore directly grounded without using semiconductive material.

Here the biasing unit 40 constitutes the displacement mechanism. In concrete terms, the displacement mechanism includes the biasing base 41, the biasing link 42 and the biasing cap 43.

As described above, Example 1 provides for a mechanism as a displacement mechanism to displace the position of the optical sensor unit 29 to the first position or the second position, interlocking with the opening/closing operation of an intermediate transfer unit replacement door 50. Therefore, the transfer material transport guide 35 can be grounded via the biasing base 41 made of semiconductive material at the first position. As a result, the grounding can be achieved at a level of resistance which does not cause transfer failure due to the leak of transfer bias. At the second position, the intermediate transfer unit replacement door 50 is open, and the transfer material transport guide 35 is directly grounded, so as to prevent an electrostatic breakdown caused by user access when the intermediate transfer unit 5 is replaced or jammed transfer material is removed. As a result, the grounding path can be shared, and the transfer material transport guide 35 can play both roles of the transfer bias leak prevention and the electrostatic breakdown prevention, which can downsize the apparatus. Furthermore, the optical sensor unit 29 moves away from the intermediate transfer unit 5, hence the intermediate transfer unit 5 can be prevented from contacting and scratching the optical sensor unit 29 when the intermediate transfer unit 5 is replaced. As a result, the space between the optical sensor unit 29 and the intermediate transfer unit 5, required for replacement, can be provided when the optical sensor unit 29 is at the second position. This means that when the optical sensor unit 29 is at the first position, it is unnecessary to provide a space for replacement, and the optical sensor unit 29 may be close to the intermediate transfer unit 5, which improves the resolution of the optical sensor.

Although the present invention has been described using a specific example, the present invention is not limited to the above example. The intermediate transfer system which uses the intermediate transfer belt as the image bearing member is described in Example 1. However, the image forming apparatus can use a photosensitive drum as the image bearing member, so that the toner image formed on the photosensitive drum is transferred to the transfer material (this is the same for Example 2).

The optical sensor unit 29 is the color resist sensor in Example 1. However, the optical sensor unit 29 can be used for other devices which require protection from electrostatic breakdown.

The biasing base 41 is constituted by the semiconductive member in Example 1. However, the present invention is not limited to this configuration. The same effect can be implemented for a configuration of disposing a sheet material made of a sheet type semiconductive material on the main body frame 2, or a configuration of disposing an electric resistance component, such as a plate type resistor, and grounding the transfer material transport guide 35 at the first position using the sheet material or the electric resistance component.

EXAMPLE 2

Figure 4A:
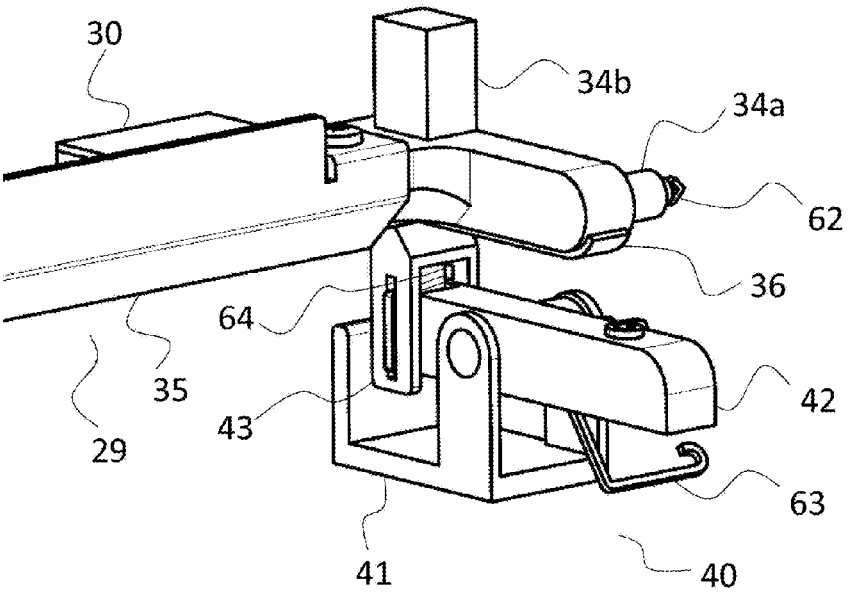
FIGS. 4A and 4B are general views of the optical sensor unit 29 according to Example 2 of the present invention.
Figure 4B:
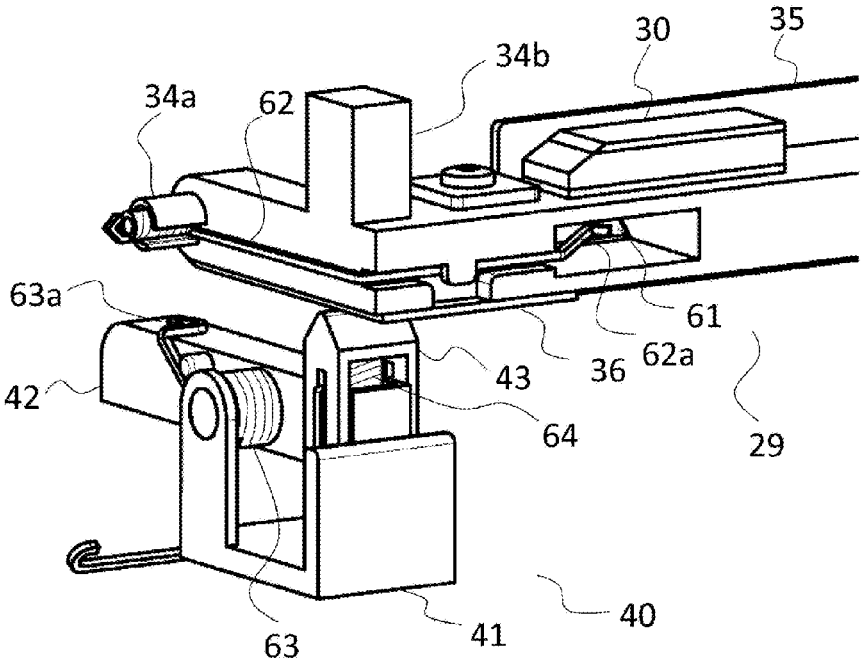

Example 2 of the optical sensor unit 29 according to the present invention will be described with reference to FIGS. 4A, 4B, 5A and 5B. FIGS. 4A and 4B illustrate diagrams depicting the optical sensor unit 29 according to Example 2 of the present invention, and the only difference from the optical sensor unit in FIGS. 3A and 3B is the grounding path; hence, elements the same as those in FIGS. 3A and 3B are denoted with the same reference signs. As illustrated in FIGS. 4A and 4B, a second earth member conducting portion 62*a*, which is one end of the second earth member 62 (second conductive member) that is a wire spring, biases a sheet type intermediate resistance member 61, which is constituted by a semiconductive member, toward the transfer material transport guide 35. The other end of the second earth member 62 is biased to the main body frame 2 (not illustrated), and grounded via the shaft 34*a* of the optical sensor support member 34. The sheet type intermediate resistance member 61 constituted by the semiconductor member is a Bearee sheet, for example, and the surface resistance is 2.6×10^7 Ω·cm. On the biasing link 42 of the biasing unit 40, a biasing link earth member (third conductive member) 63, which is a torsion coil spring, is disposed. A biasing link earth member conducting portion (contact portion) 63*a* at one end of this biasing link earth member 63 is located on a surface facing the shaft 34*a* of the optical sensor support member 34 of the biasing link 42. The other end thereof is grounded to the main body frame 2 (not illustrated). The biasing spring conducting portion 44a in the biasing spring 44 in Example 1 is unnecessary because of the change in the grounding path; therefore, in Example 2, the biasing spring 64, which is a simple compression spring, is used as the spring to bias the biasing cap (second support portion) 43. In the same manner, the biasing base 41 and the biasing cap 43 can also be made of a general insulating material because of the change in the grounding path.

Figure 5A:
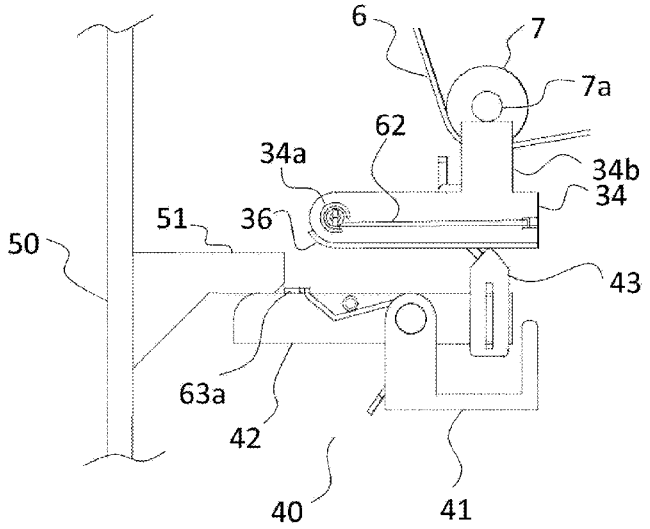
FIGS. 5A and 5B are rear views illustrating the operation of the optical sensor unit 29 according to Example 2 of the present invention.

An operation of the optical sensor unit 29 of Example 2 will be described with reference to FIGS. 5A and 5B. As illustrated in FIG. 5A, in the state when the intermediate transfer unit replacement door 50 is closed, the optical sensor unit 29 is located at a first position where the optical sensor unit 29 is biased to the drive roller shaft 7*a*, as in Example 1. Thus, the transfer material transport guide 35 is grounded to the main body frame 2 via the intermediate resistance member 61 made of semiconductive material and the second earth member 62.

Figure 5B:
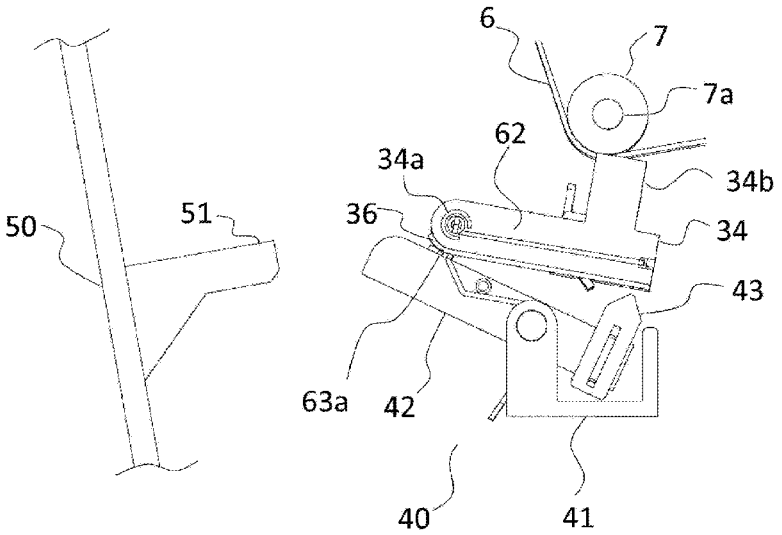

On the other hand, as illustrated in FIG. 5B, when the intermediate transfer unit replacement door 50 is open, the optical sensor unit 29 is located at the second position where the optical sensor unit 29 is not biased to the drive roller 7, as in Example 1. Therefore the biasing link earth member conducting portion 63*a* contacts the first earth member 36 by the biasing force generated by the torsion coil spring of the biasing link earth member 63 attached to the biasing link 42. As a result, the transfer material transport guide 35 is grounded via the first earth member 36 and the biasing link earth member 63.

By creating the grounding path like this, the same effect as Example 1 can be implemented.

In Example 2, a member made of semiconductive material is disposed in the optical sensor unit 29. Therefore semiconductive material need not be used for the biasing base 41 of the biasing unit 40. Further, the biasing spring conducting portion 44*a*, disposed in the biasing spring 44 in Example 1, is not required, hence the biasing unit 40 can be downsized. and design flexibility improves. As a result, downsizing of the apparatus can also be achieved.

Furthermore in Example 2, the biasing link earth member conducting portion 63*a* located on the biasing link 42 contacts the first earth member 36 when the optical sensor unit 29 is at the second position. At this time, the biasing link earth member conducting portion 63*a*, as the third support portion, may support not only the biasing link 42, but also the optical sensor unit 29 located at the second position. The optical sensor unit 29 may be supported by a different member, and the biasing link earth member conducting portion 63*a* may only contact the first earth member 36 for electric connection.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-130433, filed on Jul. 3, 2017, which is hereby incorporated by reference herein in its entirety.

What is claimed is:

1. An image forming apparatus, comprising:

an image bearing member configured to bear a toner image;

a guide member configured to guide a transfer material to a transfer portion for transferring the toner image from the image bearing member to the transfer material; and an electric unit that comprises a device configured to be activated by electric power supply, wherein the electric unit is configured to move to a first position and to a second position that is more retracted from the image bearing member than the first position, the guide member is grounded via a resistance member when the electric unit is positioned at the first position, the guide member is grounded without the resistance member when the electric unit is positioned at the second position.

2. The image forming apparatus according to claim 1, further comprising:

an opening and closing member configured to expose an inside of the image forming apparatus, wherein a movement of the electric unit between the first position and the second position interlocks with a movement in which the opening and closing member is opened and closed.

3. The image forming apparatus according to claim 2, further comprising:

a displacement mechanism configured to displace the electric unit to the first position or to the second position, the displacement mechanism comprising a support portion that supports the electric unit, an engaged portion that supports the support portion and that can be engaged with an engaging portion which is provided on the opening and closing member, and a base portion that supports the engaged portion rotatably and includes the resistance member, wherein the displacement mechanism supports the electric unit such that the electric unit is positioned at the first position when the opening and closing member is closed and the engaging portion and the engaged portion are engaged with each other, and the displacement mechanism supports the electric unit such that the electric unit is positioned at the second position when the opening and closing member is opened and the engaging portion and the engaged portion are disengaged from each other.

4. The image forming apparatus according to claim 3, wherein the electric unit further comprises a support receiving portion that is conductive and that is electrically connected with the guide member, the support portion is conductive, contacts the support receiving portion to support the electric unit, and is electrically connected with the support receiving portion, the displacement mechanism further comprises a conducting portion that is conductive and that is electrically connected with the support portion, the conducting portion is grounded via the resistance member when the engaging portion and the engaged portion are engaged with each other, and the conducting portion is grounded via a conductive member when the engaging portion and the engaged portion are disengaged from each other.

5. The image forming apparatus according to claim 3, wherein the electric unit further comprises a first conductive member that is electrically connected with the guide member via the resistance member and that is grounded via the resistance member, the electric unit further comprises a support receiving portion that is conductive and that is electrically connected with the guide member, the displacement mechanism further comprises a second support portion that contacts the support receiving portion to support the electric unit, the displacement mechanism further comprises a contact portion that is conductive and that contacts the support receiving portion to be electrically connected with the support receiving portion and that is grounded via a second conductive member, when the support receiving portion is engaged with the engaging portion, the second support portion contacts the support receiving portion to support the electric unit such that the electric unit is positioned at the first position and the guide member is grounded via the resistance member, and when the support receiving portion is disengaged from the engaging portion, the electric unit is positioned at the second position where the contact portion contacts the support receiving portion and the guide member is grounded via the second conductive member.

6. The image forming apparatus according to claim 1, wherein the device is an optical sensor.

7. The image forming apparatus according to claim 6, wherein the image bearing member is an intermediate transfer member, and the optical sensor is a sensor configured to detect the toner image borne on the intermediate transfer member.

8. The image forming apparatus according to claim 6, wherein the optical sensor is positioned near the image bearing member when the electric unit is at the first position, and a space for allowing attaching and detaching of the image bearing member can be provided when the electric unit is at the second position.

9. The image forming apparatus according to claim 1, further comprising:

a biasing member configured to bias the electric unit, wherein the first position is a position where the electric unit is biased to the image bearing member by the biasing member.

10. The image forming apparatus according to claim 1, wherein the guide member is configured to move together with the electric unit.

11. An image forming apparatus, comprising:

an image bearing member configured to bear a toner image;

a movable unit that comprises a device configured to be activated by electric power supply and a guide member configured to guide a transfer material to a transfer portion for transferring the toner image from the image bearing member to the transfer material, the movable unit is configured to move to a first position and to a second position that is more retracted from the image bearing member than the first position;

a main body frame that comprises a conducting portion;

an opening and closing member which is capable of being opened and closed relative to the main body frame, wherein movement of the movable unit between the first position and the second position is interlocked with movement in which the opening and closing member is opened and closed; and a displacement mechanism configured to displace the movable unit to the first position or to the second position and contact the movable unit, wherein when the movable unit is positioned at the second position according to the movement of the opening and closing member, the displacement mechanism is configured to contact the conducting portion directly to eliminate electricity from the moveable unit.

12. The image forming apparatus according to claim 11, wherein the conducting portion is made of metal.

13. The image forming apparatus according to claim 12, wherein when the movable unit is positioned at the first position according to the movement of the opening and closing member, the displacement mechanism is configured not to contact the conducting portion directly.

14. The image forming apparatus according to claim 11, wherein the device is an optical sensor.

15. The image forming apparatus according to claim 14, wherein the image bearing member is an intermediate transfer member, and the optical sensor is a sensor configured to detect the toner image borne on the intermediate transfer member.

16. The image forming apparatus according to claim 15, wherein the optical sensor is positioned near the image bearing member when the movable unit is at the first position, and a space for allowing attaching and detaching of the image bearing member is provided when the movable unit is at the second position.

* * * * *